US006978030B2

(12) United States Patent
Reich

(10) Patent No.: US 6,978,030 B2
(45) Date of Patent: Dec. 20, 2005

(54) LIGHT EMITTING LOUDSPEAKER COVER

(76) Inventor: Ronald S. Reich, 102 S. Stonehedge Dr., Basking Ridge, NJ (US) 07920

( * ) Notice: Subject to any disclaimer, the term of this patent is extended or adjusted under 35 U.S.C. 154(b) by 744 days.

(21) Appl. No.: 09/950,843

(22) Filed: Sep. 13, 2001

(65) Prior Publication Data

US 2003/0048912 A1 Mar. 13, 2003

(51) Int. Cl.[7] ..... H04R 1/02; F21V 33/00

(52) U.S. Cl. ..... 381/124; 381/386; 381/87; 362/86; D14/204

(58) Field of Search ..... 381/87, 172, 124, 381/386, 394, 395; 362/84, 85, 86; 359/285; 398/133, 134; 181/148, 150, 179, 180, 198, 181/199; D14/221, 224, 204, 210; 385/147

(56) References Cited

U.S. PATENT DOCUMENTS 4,559,584 A * 12/1985 Kuwahata et al. ..... 362/86
4,817,163 A * 3/1989 Stastny ..... 381/150
4,875,143 A * 10/1989 Fernandez ..... 362/86
5,829,863 A * 11/1998 Gutshall ..... 362/123
5,917,288 A * 6/1999 Feldman et al. ..... 315/169.3
6,000,493 A * 12/1999 Chen ..... 181/141
6,144,752 A * 11/2000 Chen ..... 381/386
6,270,229 B1 * 8/2001 Chien ..... 362/84
6,545,418 B1 * 4/2003 Kolpasky et al. ..... 315/77
6,652,132 B1 * 11/2003 Hsueh ..... 362/567

FOREIGN PATENT DOCUMENTS

FR 2485316 * 5/1982 ..... H05B 39/04

* cited by examiner

*Primary Examiner*—Xu Mei
(74) *Attorney, Agent, or Firm*—Walter J. Tencza, Jr.

(57) ABSTRACT

An apparatus comprising a loudspeaker located inside a housing and a loudspeaker cover is disclosed. An audio signal source supplies an audio signal to the loudspeaker within the housing. The loudspeaker cover includes one or more light sources and is porous to allow sound waves generated by the loudspeaker to be emitted from within the housing through loudspeaker cover. The loudspeaker cover may be comprised of a plurality of optical fibers which may be arranged in any pattern. A user input device may be provided which allows a user to selectively activate one or more of the plurality of procedures to drive the light sources based on frequency and amplitude. The apparatus may further include a control device which may determine frequency and amplitude data for the audio signal and control one or more of the light sources based on the frequency and amplitude data. A method is further disclosed comprising constructing a porous cover having a plurality of light sources for a loudspeaker.

24 Claims, 5 Drawing Sheets

LIGHT EMITTING LOUDSPEAKER COVER

FIELD OF THE INVENTION

This invention relates to improved methods and apparatus concerning covers for loudspeakers and entertainment lighting.

BACKGROUND OF THE INVENTION

Typically in the prior art a loudspeaker resides in a housing. For protective and aesthetic reasons a cover is placed over the radiating face of the loudspeaker concealing the loudspeaker's components. The cover must allow sound to pass unimpeded while simultaneously serving the protective and aesthetic functions of loudspeaker covers. These porous covers can be made of cloth or other porous material.

In the past, loudspeaker covers have been passive devices. Some as in U.S. Pat. Nos. 6,142,254, and 5,717,171, describe enhanced aesthetic covers for loudspeakers.

In the Entertainment Lighting field, many patents, such as U.S. Pat. Nos. 4,000,679, and 4,265,159 describe entertainment lighting devices which actively respond to sound waves. Amplitudes of the sound waves are often used to turn lights on and off as well as to adjust brightness. Relative frequency and/or time sequencing is often used to operate different colored lights. These devices are not integral with loudspeakers.

Many devices which are used to tune stringed instruments are known in the art and are capable of determining the dominant frequency of an electrical signal from a musical instrument. U.S. Pat. No. 4,151,775 discloses such a device. These devices were not intended for entertainment lighting.

SUMMARY OF THE INVENTION

A light emitting loudspeaker cover is disclosed which is capable of displaying visual content while remaining acoustically transparent. A control device is provided which analyzes an audio electrical signal driving a loudspeaker and in turn drives a light source device. The control device may be comprised of a signal processor. The light source device is comprised of one or more light sources. The light sources can be integrated into the loudspeaker cover in one of several ways. In one embodiment, optical fiber may be woven into cloth or provided in a grid to comprise the loudspeaker cover. A plurality of optical fibers may be provided in a grid with or without being woven into cloth. Other patterns may be formed with the optical fibers, other than a typical grid, such as concentric circles, spider webs, random mesh, zigzag patterns, etc. All of these patterns can be useful for making loudspeaker covers with responsive lighting.

In another embodiment, the light source device may be comprised of a plurality of light emitting diodes ("LEDs") mounted directly onto an acoustically transparent printed circuit board. In another embodiment, the light source device may be comprised of a plurality of light sources wired together and then woven into a loudspeaker cloth cover.

The present invention in one embodiment discloses an apparatus which includes a loudspeaker for converting electrical energy into sound energy, a housing in which the loudspeaker resides, a control device which may include a signal processor to determine frequency and amplitude and a lighting control device to drive a light source device comprised of a plurality of light sources integrated into a loudspeaker cover. An audio signal source, such as a musical instrument, audio component, or microphone, supplies an audio signal to the loudspeaker. The audio signal drives both the loudspeaker and the control device which in turn, drives the lighting source device comprised of a plurality of light sources. The cover includes one or more light sources and is porous to allow sound waves generated by the loudspeaker to be emitted from within the housing through the loudspeaker cover.

The loudspeaker cover may be comprised of a plurality of optical fibers which may be arranged in a grid of horizontal and vertical optical fibers or any pattern which allows for the protective and aesthetic function without materially impeding the sound waves. A user input device, such as a dial, switch, keyboard, mouse, or other user input device, may be provided which allows a user to selectively activate one or more of a plurality of procedures or methods to adjust the control device and thereby adjust control of the light source device. (For example: One procedure may associate frequency with color. In other words if the audio signal has a certain frequency, then the light from the light sources may be controlled by the control device so that the light emitted is green. Another procedure may use color randomly and associate frequency of the audio signal from the audio signal source with position such that high frequencies appear as light emitted from a high point on the loudspeaker cover. Another procedure may create moving waves or outward bursts of light, etc.)

The control device of the apparatus may further include a signal processing device which may determine frequency and amplitude data for the audio signal and control one or more of the light sources of the light source device based on the frequency and amplitude data.

The present invention further includes a method comprising the steps of constructing a cover for a loudspeaker, wherein the loudspeaker includes a housing. The cover may be constructed so that it is comprised of a plurality of light sources and is porous so that sound waves can be emitted from within the housing of the loudspeaker through the cover.

The present invention in various embodiments combines active/responsive entertainment lighting with loudspeaker covers. This has never been achieved before. This is an improvement in that previously, there was no effective way to have sound and light emanate from the same position. This invention is also unique in that it integrates entertainment lighting and sound reinforcement. Lighting is often too expensive for small audiences. This invention addresses that problem by making it a part of the cover for loudspeakers and thus embodiments of the invention are easy to set-up and cost effective to run.

DETAILED DESCRIPTION OF THE DRAWINGS

Figure 1:
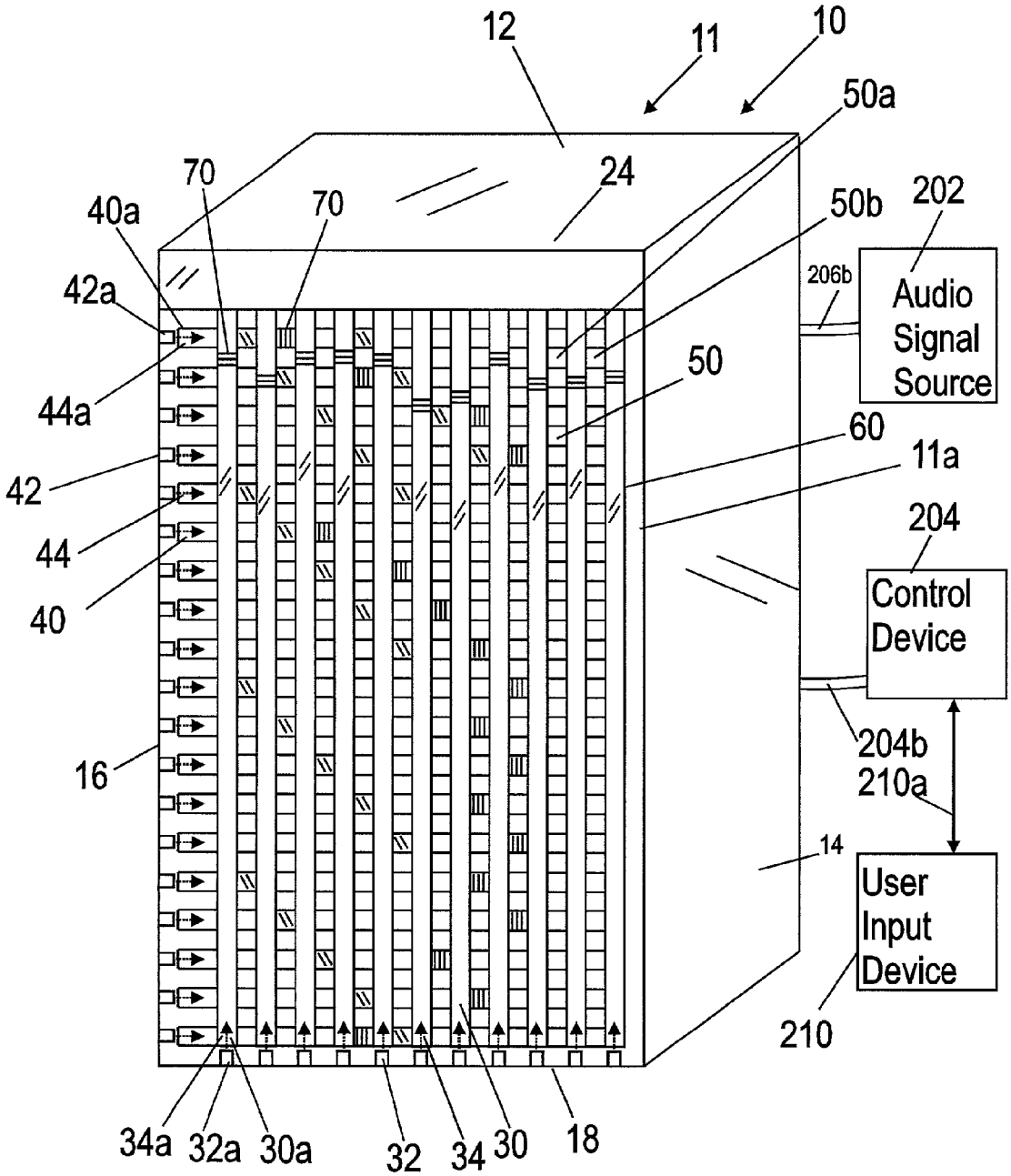
FIG. 1 shows a perspective view of an apparatus in accordance with a first embodiment of the present invention.

FIG. 1 shows a perspective view of an apparatus 10 in accordance with a first embodiment of the present invention. The apparatus 10 may include a loudspeaker housing 11 and various components within or connected to the loudspeaker housing 11. The loudspeaker housing 11 may include walls 12, 14, 16, and 18. The apparatus 10 includes an audio signal source 202 which supplies an audio signal to a loudspeaker 206 (see FIG. 3) within loudspeaker housing 11.

A plurality of optical fibers are shown at the front 10*a* of the apparatus 10 and attached to the speaker housing 11. The plurality of optical fibers may be woven into a cloth material, mesh, grate, grid, or screen such as used for covers for known loudspeakers. The plurality of optical fibers includes nineteen horizontal optical fibers 40, which includes horizontal optical fiber 40*a*, and eleven vertical optical fibers 30, which includes vertical optical fiber 30*a*. Also shown attached to the housing 11 are a plurality of horizontal light sources 42, such as light source 42*a*, emitting a plurality of light beams 44, such as light beam 44*a*, and a plurality of vertical light sources 32, such as light source 32*a*, emitting a plurality of light beams 34, such as light beam 34*a*. The horizontal optical fibers 40 may be connected to the vertical optical fibers 30 to form a grid 60 which can be placed over the front 11*a* of the loudspeaker housing 11 as shown in FIG. 1. The grid 60 forms a cover of a loudspeaker 206 located within the housing 11. The apparatus 10 may include the audio signal source 202 which may be outside housing 11, and which sends audio signals to a loudspeaker 206 located within the housing 11. The loudspeaker 206 may convert the electrical audio signals to sound energy and sound waves corresponding to the electrical audio signal may be emitted from the loudspeaker 206 inside the housing 11, and through the grid 60 of horizontal optical fibers 40 and vertical optical fibers 30.

The grid 60 of optical fibers may be a cloth made entirely of optical fibers or the grid 60 may be optical fibers woven into a separate cloth.

The grid 60 of horizontal optical fibers 40 and vertical optical fibers 30 has air spaces 50, such as air space 50*a* and 50*b*, through which sound waves from the inside of the housing 11 can travel to the outside of the housing 11.

Figure 3:
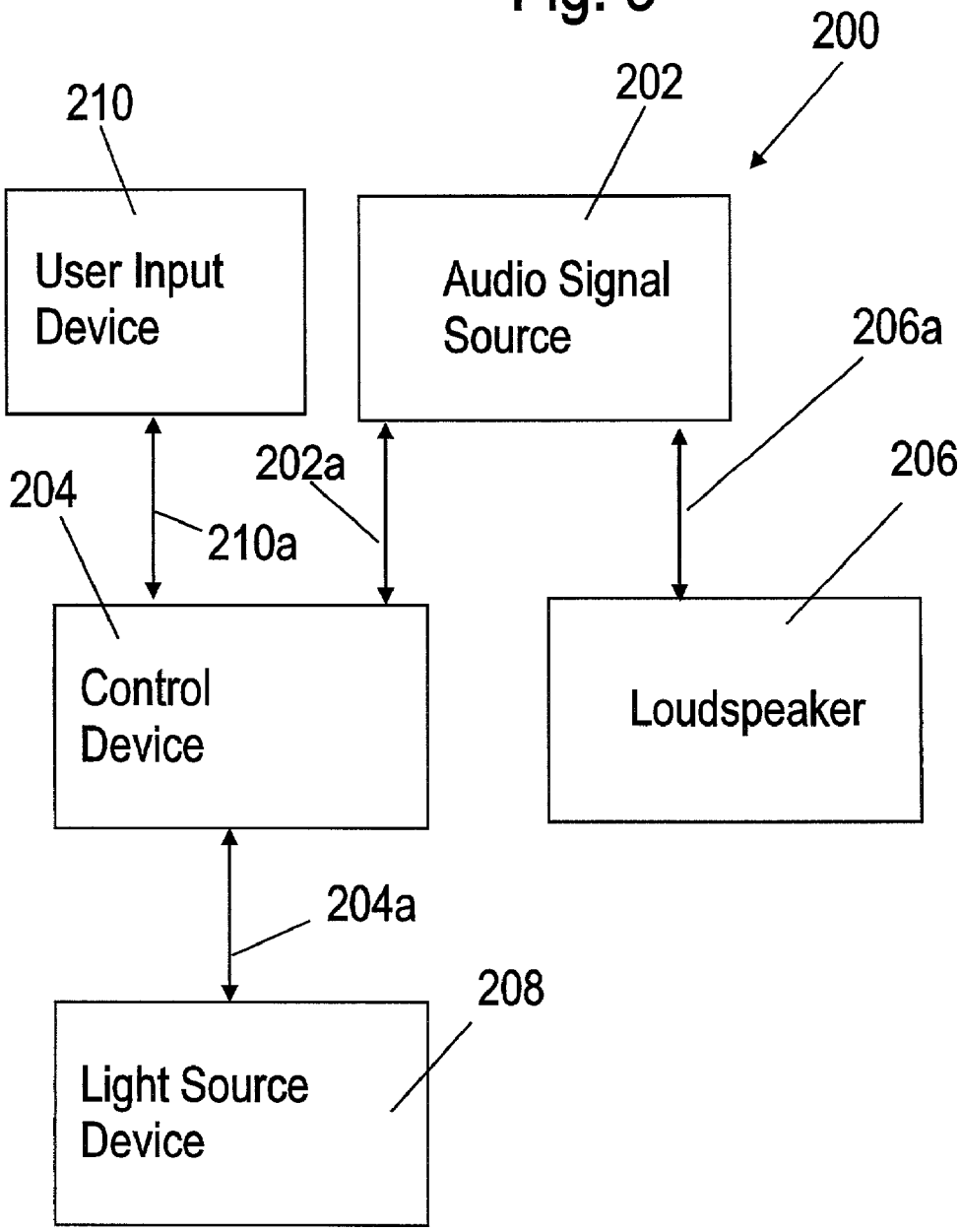
FIG. 3 shows a block diagram of the general components for use with the first or second embodiment of the present invention.

As shown in FIGS. 1 and 3, an audio signal source 202, which may be for example a musical instrument such as an electrical guitar, is shown connected by bus 206*a* through cable 206*b* to loudspeaker 206. Also as shown in FIGS. 1 and 3, a control device 204 is shown connected by bus 204*a* through cable 204*b*, a light source device 208 which may be comprised of the plurality of optical fibers 30 and 40.

The general operation of the apparatus 10 of the present invention will now be described. Each of the horizontal light sources 42 and vertical light sources 32 can be selectively activated by the control device 204. For example, light source 42 can be activated to cause light beam 44*a* to be emitted from the light source 42 and into horizontal optical fiber 40*a*. Some of the light from light source 42 will travel the length of the optical fiber 40*a* until it reaches wall 14 of the housing 11 where it is reflected back. However, some of the light from light source 42 will be emitted, out away from the housing 11, through scores or cuts 70*a*, 70*b*, and 70*c* of optical fiber 40*a* shown in FIG. 5. Any of the other horizontal light sources 42 can also be activated to cause the corresponding horizontal optical fiber of optical fibers 40 to be activated.

Similarly, vertical light source 32 can be activated to cause light beam 34*a* to be emitted from light source 32 and into vertical optical fiber 30*a*. Some of the light from light source 32 will travel the length of the optical fiber 30*a* until it reaches wall 12 of the housing 11 where it is reflected back. However, some of the light from light source 32 will be emitted, out away from the housing 11, through scores or cuts 70*a*, 70*b*, and 70*c*. Any of the other vertical light sources 32 can also be activated to cause the corresponding vertical optical fiber 30 to be activated.

Any of the optical fibers 30 or 40 can be activated while sound waves are being emitted from the housing 11 through the grid 60 of horizontal and vertical fiber optical fibers. Two or more of the plurality of light sources 40 can be replaced by a larger single light source which can supply light to more than one optical fiber. Similarly two or more of the plurality of light sources 30 can be replaced by a larger single light source, which can also supply light to more than one optical fiber.

Figure 2:
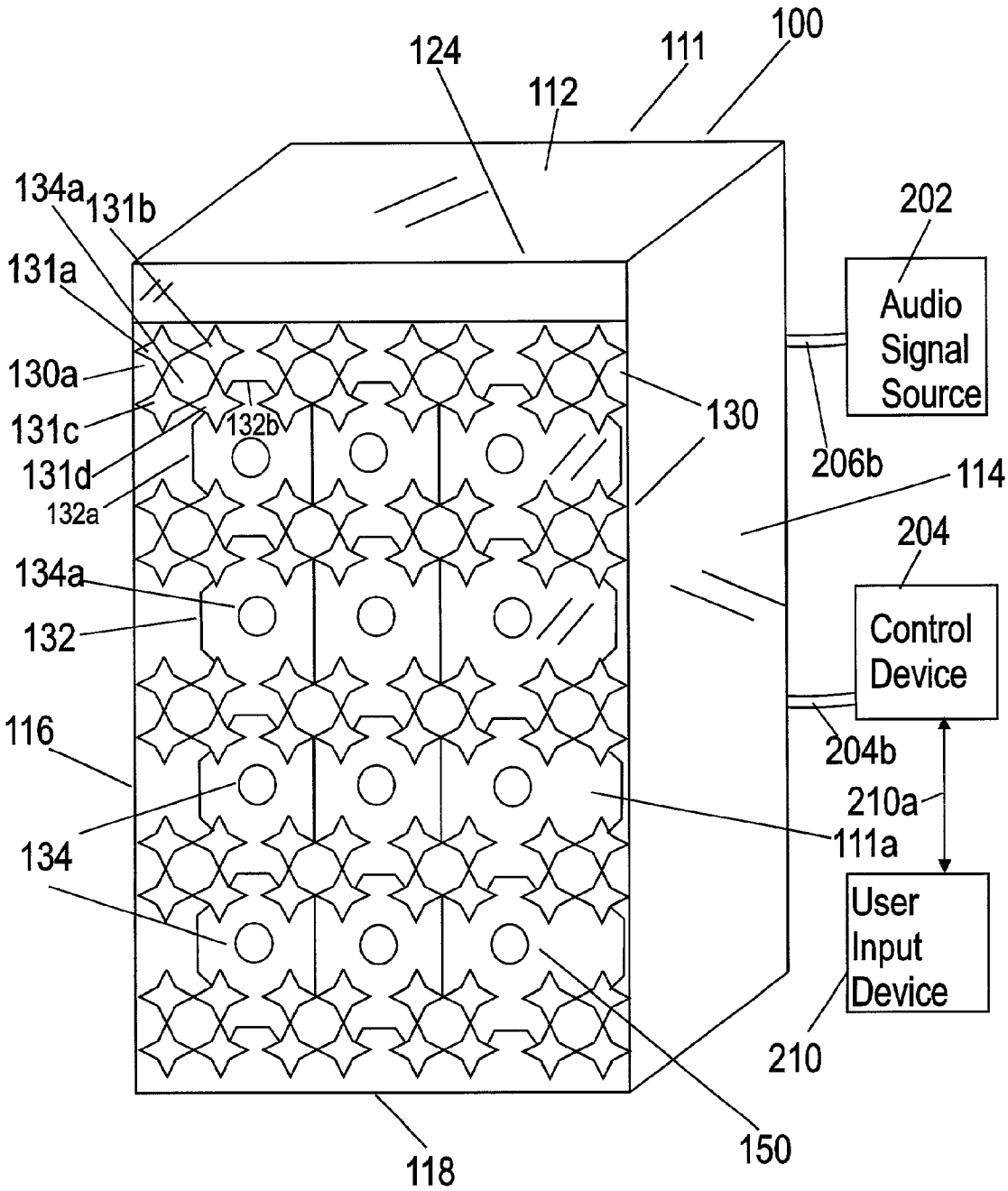
FIG. 2 shows a perspective view of an apparatus in accordance with a second embodiment of the present invention.

FIG. 2 shows a perspective view of an apparatus 100 in accordance with a second embodiment of the present invention. The apparatus 100 includes a housing 111 which includes walls 112, 114, 116, and 118. The housing 111 is similar to the housing 11 of FIG. 1. The apparatus includes audio signal source 202, control device 204 and user input device 210 as in FIG. 1.

The apparatus 100 of FIG. 2 includes a circuit board 150 at a front 111*a* of the housing 111 of the apparatus 100. The circuit board 150 has a plurality of openings 134, such as 134*a*, for allowing sound waves to be emitted from the inside of housing 111 through the circuit board 150 and into the area outside housing 111. Also shown are a plurality of sets 130 of four light emitting diodes ("LEDs"). For example, FIG. 2 shows a set 130*a* of light emitting diodes which includes LEDs 131*a–d*. The sets 130 of LEDs are electrically connected to control device 204 by a grid 132 of conductors, which includes for example conductors 132*a* and 132*b*, and by bus 204*a* in cable 204*b*. The control device 204 can selectively activate one or more sets of the LEDs 130, such as for example set 130*a*. When set 130*a* is activated the LEDs 131*a–d* light up.

FIG. 3 shows a block diagram 200 of the general components for use with the first or second embodiment of the present invention. Block diagram 200 includes audio signal source 202, control device 204, loudspeaker 206, light source device 208, and user input device 210. The control device 204 may be electrically connected by a bus 204*a* to the light source device 208. The control device 204 may include a signal processing device. Audio signal source 202 may be electrically connected to loudspeaker 206 by a bus 206*a*, wire 206*b*, and to the control device 204 by a bus 202*a*. The user input device 210 may be electrically connected by a bus 210*a* to the control device 204. Busses 202*a*, 204*a*, 206*a*, and 210*a* may be wireless busses, hardwired busses or any type of electrical, optical, or communication connection.

The control device 204 may be employed outside the apparatus 10 of FIG. 1 by and may include means such as a remote control for example. The control device 204 may include a signal processor which may be employed within the housing 11 of apparatus 10 or housing 111 of apparatus 100. The light source device 208 may include, for example, all the light sources 32 and 42 of FIG. 1, or all the light sources 130 of FIG. 2. The audio signal source 202 would in all likelihood be located outside the housing 11 or 111 of apparatus 10 or 100 and may include any known devices for generating audio signals such as musical instruments. The loudspeaker 206 would be located within housing 11 or 111.

Figure 4:
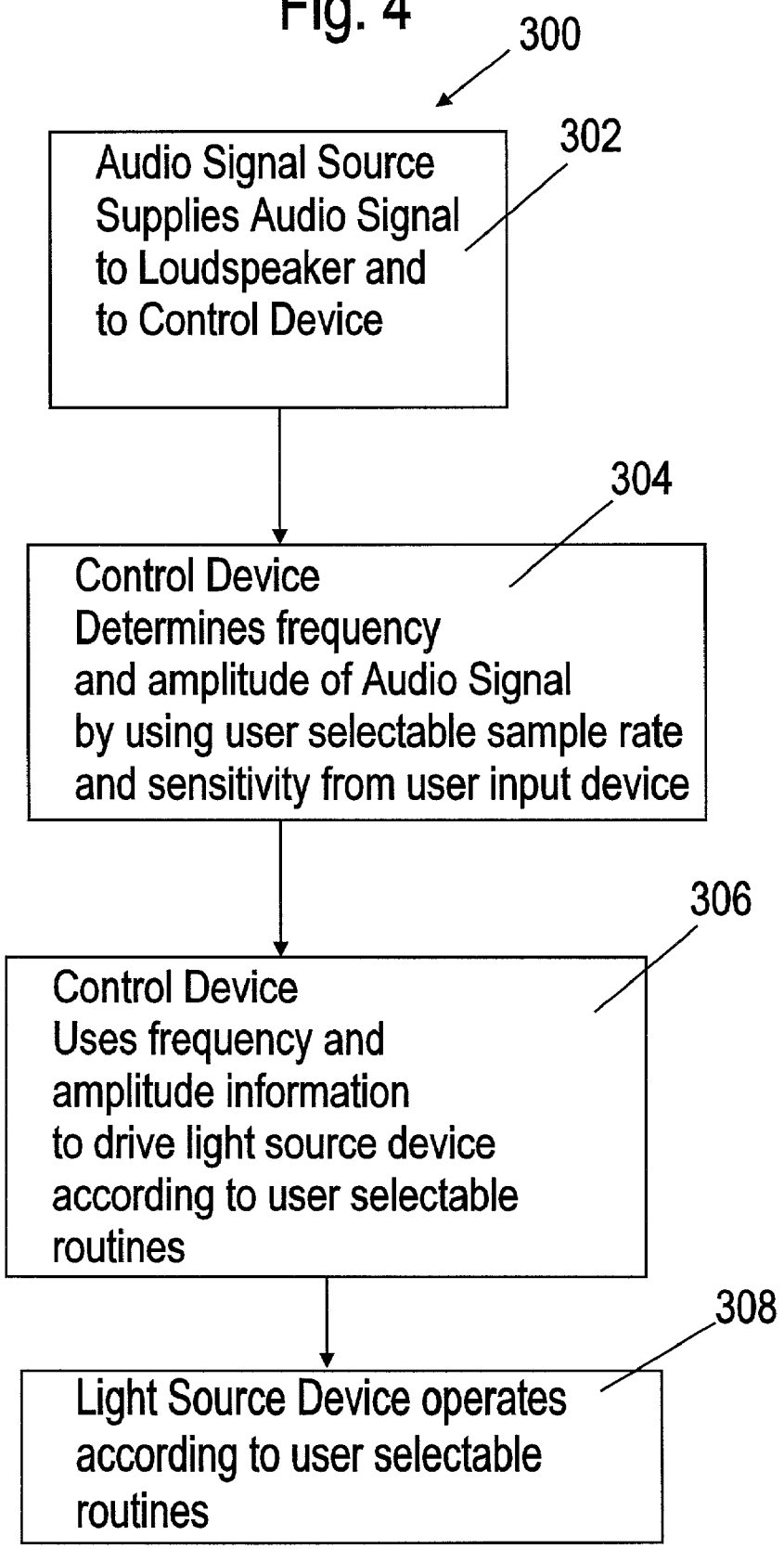
FIG. 4 shows a flow chart of a method of the present invention.

FIG. 4 shows a flow chart 300 of a method of the present invention. At step 302 audio signal source 202 supplies an audio signal to loudspeaker 206 via bus 206*a* and to control device 204 via bus 202*a*. At step 304 the control device 204 determines the frequency and amplitude of the audio signal, in one embodiment by using a user selectable sample rate and sensitivity provided from the user input device 10 via bus 210*a*. At step 306 the control device 204 uses the frequency and amplitude information to control the light source device 208.

The control device 204 may use analog or digital signals to drive or control the light source device 208 via bus 204*a*.

The user input device 210 can be used to select a sample rate for sampling the audio signals from the audio signal source 202. The greater the sample rate the faster the light source device 208 can be controlled by the control device 204. The user input device 210 can be used to select frequency sensitivity of the control of the light source device 208, i.e. the extent to which overtones and non-dominant frequencies in the audio signals from the audio signal source 202 are filtered out. The user input device can also be used to determine the extent to which the control device 204 will respond to a minimum and maximum amplitude.

The user input device 210 can be used to select frequency translation parameters. For example, a frequency can be associated with color to be emitted by one or more of the optical fibers 30 and 40. For example, if the frequency of an audio signal from audio signal source 202 is 440 Hz. one of the light sources of the light source device 206 can be controlled to emit the color blue. Similarly, a particular frequency may light up a particular horizontal optical fiber of fibers 40 or vertical optical fiber of fibers 30. A particular frequency may be associated with both a particular color and a particular position. Alternatively color and position selection may be random.

The user input device 210 can be used to select amplitude translation parameters. For example, the amplitude of an audio signal from audio signal source 202 may be used to control through control device 204 the brightness of the light emitted by one or more of the light sources of the light source device 208. The amplitude may alternatively be used to control an on off speed of one or more light sources or both brightness and on-off speed.

The user input device 210 may be used to control overall brightness of the light source device 208 or overall color selection or whether one or more light sources of the light source device 208 is turned off.

The control device 204 may determine the frequency of audio signals from audio signal source 202 supplied via bus 202*a* and may use the frequency to control the color of light emitted from one or more of the lights of the light source device 206. For example, if the audio signal is 100 hertz, the color of light emitted from light source 42*a* in FIG. 1 may be set by the control device 204 to be green (in some embodiments through a user input through user input device 210).

The control device 204 may use the frequency of the audio signals to determine position as previously described. The control device 204 may use the amplitude of audio signals from the audio signal source 208 to determine brightness of the light emitted by the lights of light source device 208.

Each light source, such as light source 42*a* in FIG. 1, may actually be comprised of a plurality of LEDs, a plurality of incandescent light sources, a plurality of lasers, or other lights or light sources known.

The light emitting loudspeaker cover may be comprised of light elements wired together and woven into a porous loudspeaker cloth, or formed into a mesh.

Figure 5:
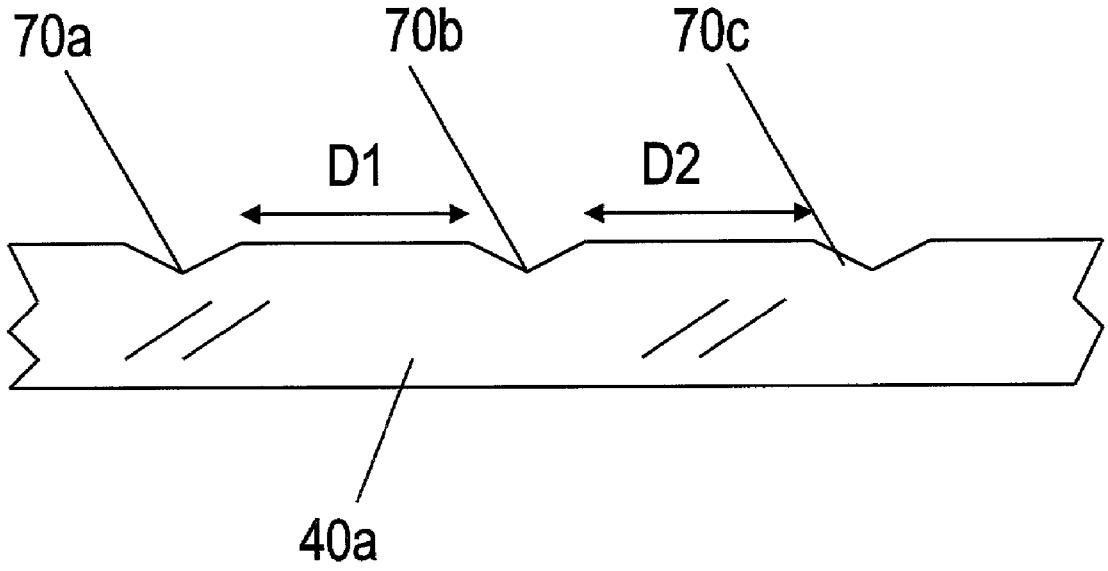
FIG. 5 shows a scored portion of an optical fiber for use in the FIG. 1 embodiment.

Each of the plurality of optical fibers, such as for example each of optical fibers 30 or 40, may be scored along its length to allow light to escape at points along the length of each fiber. Scores 70 are shown in FIG. 1. Most optical fibers are designed to carry light from end to end with no leakage. This application in one embodiment provides that light escapes at set intervals along the length of each fiber. The spacing between the scores or cuts in optical fiber 40*a* as shown in FIG. 5 may be uniform. For example, the distance D1 between score or cut 70*a* and score or cut 70*b* may be the same as the distance D2 between the scores or cuts 70*b* and 70*c*.

Allowing light to escape the optical fiber is achieved by "scoring" or notching each optical fiber of optical fibers 30 and 40 along its length or removing (in certain cases) a "cladding" which prevents light from "leaking" from the fiber. Optical fibers may be as fine as a hair or as fat as is practical, but they all should be scored in some way to allow for leakage in embodiments of the present invention. The optical fibers 30 and 40 can be provided with scores or cuts, which may be equally spaced out, and in some embodiments along the entire length of the respective optical fibers. The scoring of the fibers may be done according to any pattern. Random scoring may be desirable in certain instances as may spiral scoring, for example FIG. 5 shows a scored portion of an optical fiber 40*a* for use in the FIG. 1 embodiment. The optical fiber 40*a* includes scores or cuts 70*a*, 70*b*, and 70. The optical fiber 40*a* is generally a solid cylinder as are all of optical fibers 30 and 40. The other optical fibers each also have similar scores or cuts which are shown as vertical lines for optical fibers 40, and horizontal lines for optical fibers 30. The plurality of scores or cuts for optical fibers 30 and 40 are referred to in total as 70.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a housing;

a loudspeaker located within the housing;

a loudspeaker cover, wherein the loudspeaker cover has a length, a width, and a center;

an audio signal source which supplies an audio electrical signal to the loudspeaker;

and wherein the loudspeaker cover includes a first light source and the loudspeaker cover is porous to allow sound waves generated within the housing by the loudspeaker to be emitted from within the housing through the loudspeaker cover;

and wherein the loudspeaker cover includes a first optical fiber;

wherein the first optical spans substantially the entire width of the loudspeaker cover and the first optical fiber passes approximately through the center of the loudspeaker cover;

and wherein the first light source supplies light to the first optical fiber.

2. The apparatus of claim 1 further comprising:

a control device which receives the audio electrical signal and drives the first light source of the loudspeaker cover.

3. The apparatus of claim 1 wherein the loudspeaker cover is comprised of a plurality of further optical fibers;

wherein each of the plurality of further optical fibers spans substantially the entire width of the loudspeaker cover;

and wherein the first optical fiber and the plurality of further optical fibers are spaced apart from one another.

4. The apparatus of claim 3 wherein the loudspeaker cover is comprised of a porous cloth;

and wherein the first optical fiber and the plurality of further optical fibers are woven into the porous cloth.

5. The apparatus of claim 3 wherein the loudspeaker cover is comprised of a grid comprised of the first optical fiber and the plurality of further optical fibers.

6. The apparatus of claim 5 wherein the loudspeaker cover is comprised of a grid comprised of the first optical fiber and the plurality of further optical fibers;

wherein the first optical fiber and the plurality of further optical fibers are substantially parallel to each other;

wherein the grid is further comprised of a plurality of substantially perpendicular optical fibers which are substantially perpendicular to the first optical fiber and the plurality of further optical fibers;

wherein the plurality of substantially perpendicular optical fibers are spaced apart from one another; and wherein the first optical fiber, the plurality of further optical fibers, and the plurality of substantially perpendicular optical fibers together define a plurality of openings in the grid through which sound can pass from within the housing through the loudspeaker cover.

7. The apparatus of claim 6 further comprising a plurality of further light sources;

wherein each of the plurality of further light sources supplies light to one of the plurality of further optical fibers and the plurality of substantially perpendicular optical fibers, so that each of the plurality of further optical fibers and the plurality of substantially perpendicular optical fibers is supplied with light by one of the plurality of further light sources.

8. The apparatus of claim 7 wherein each of the plurality of substantially perpendicular optical fibers spans substantially the entire length of the loudspeaker cover.

9. The apparatus of claim 3 wherein the loudspeaker cover includes a plurality of light sources; and wherein each of the plurality of further light source supplies light to one of the plurality of further optical fibers, so that each of the plurality of further optical fibers is supplied with light from one of the plurality of further light sources.

10. The apparatus of claim 9 further comprising a user input device which allows a user to selectively activate one or more of the first light source and any the plurality of further light sources according to pre-set procedures.

11. The apparatus of claim 9 further comprising a control device which determines frequency and amplitude data for the audio signal; and wherein the control device controls the first light source and the plurality of further light sources based on the frequency and amplitude data.

12. The apparatus of claim 11 further comprising a user input device which allows an operator to selectively activate one or more of the first light source and the plurality of further light sources according to pre-set procedures.

13. The apparatus of claim 1 further comprising a control device which determines frequency and amplitude data for the audio signal and controls the first light source based on the frequency and amplitude data.

14. The apparatus of claim 1 wherein the loudspeaker cover includes a second tight source and a second optical fiber;

wherein the second optical fiber spans substantially the entire length of the loudspeaker cover, and the second optical fiber passes approximately through the center of the loudspeaker cover;

and wherein the second light source supplies light to the second optical fiber.

15. The apparatus of claim 1 wherein the first optical fiber has a first score; and wherein light from the first light source passes into the first optical fiber in a first direction and is emitted from the first optical fiber through the first score in a second direction which is substantially perpendicular to the first direction.

16. A method comprising the steps of:

placing a loudspeaker within a housing;

constructing a loudspeaker cover and attaching it to the housing;

wherein the loudspeaker cover is contructed to have a length, a width, and a center, and the loudspeaker cover is constructed to be comprised of a first light source and the loudspeaker cover is constructed to be porous so that sound waves can be emitted from within the housing through the cover;

and wherein the loudspeaker cover is constructed to include a first optical fiber;

wherein the first optical fiber spans substantially the entire width of the loudspeaker cover and the first optical fiber passes approximately through the center of the loudspeaker cover;

and wherein the first light source supplies light to the first optical fiber.

17. The method of claim 16 wherein the loudspeaker cover is constructed to include a plurality of further optical fibers.

wherein each of the plurality of further optical fibers spans substantially the entire width of the loudspeaker cover;

and wherein the first optical fiber and the plurality of further optical fibers are spaced apart from one another.

18. The method of claim 17 wherein the loudspeaker cover is constructed to be a grid comprised of the first optical fiber and the plurality of further optical fibers.

19. The method of claim 18 wherein the first optical fiber and the plurality of further optical fibers are substantially parallel to each other; and wherein the grid is further comprised of a plurality of substantially perpendicular optical fibers which are substantially perpendicular to the first optical fibers and the plurality of further optical fibers.

20. The method of claim 17 wherein the loudspeaker cover is constructed to include a plurality of further light sources; and wherein each of the plurality of further light source supplies light to one of the plurality of further optical fibers, so that each of the plurality of further optical fibers is supplied with light from one of the plurality of further light sources.

21. The method of claim 20 further comprising selectively activating one or more of first light source and the plurality of further light sources according to preset procedures of the loudspeaker cover.

22. The method of claim 20 further comprising determining frequency and amplitude data for an audio signal generated within the housing; and controlling the first light source and the plurality of further light sources based on the frequency and amplitude data.

23. An apparatus comprising:

a housing;

a loudspeaker located within the housing;

a loudspeaker cover, wherein the loudspeaker cover has a length, a width, and a center, an audio signal source which supplies an audio electrical signal to the loudspeaker;

and wherein the loudspeaker cover includes a first light source and the loudspeaker cover is porous to allow sound waves generated within the housing by the loudspeaker to be emitted from within the housing through the loudspeaker cover;

and wherein the loudspeaker cover includes a first optical fiber;

wherein the first optical fiber spans substantially the entire length of the loudspeaker cover, and the first optical fiber passes approximately through the center of the loudspeaker cover;

and wherein the first light source supplies light to the first optical fiber.

24. The apparatus of claim 23 wherein the loudspeaker cover is comprised of a plurality of further optical fibers;

wherein each of the plurality of further optical fibers spans substantially the entire length of the loudspeaker cover;

and wherein the first optical fiber and the plurality of further optical fibers are spaced apart from one another.

* * * * *